United States Patent [19]

Draugelis

[11] Patent Number: 4,721,490

[45] Date of Patent: Jan. 26, 1988

[54] PLAY THEATRE

[76] Inventor: Edward F. Draugelis, 45799 Greenridge, Northville, Mich. 48167

[21] Appl. No.: 828,771

[22] Filed: Feb. 12, 1986

[51] Int. Cl.[4] ..... A63H 33/00

[52] U.S. Cl. ..... 446/82; 446/487

[58] Field of Search ..... 272/90 G; 446/82, 83, 446/84, 487; 160/123, 126, 330, 127

[56] References Cited

U.S. PATENT DOCUMENTS

| | | | |
|---|---|---|---|
| 2,368,188 | 1/1984 | Wise | 446/82 |
| 2,583,529 | 1/1952 | Halpern | 160/123 X |
| 2,705,386 | 4/1955 | Bertran | 446/82 |
| 2,834,150 | 5/1958 | White | 446/82 |
| 2,837,863 | 6/1958 | Duvall | 446/82 X |
| 3,063,193 | 11/1962 | Reinosa | 446/83 |
| 3,839,816 | 10/1974 | Fischereder | 446/82 |
| 3,899,168 | 8/1975 | Besherse | 446/82 |
| 4,077,403 | 3/1978 | Steele | 272/900 X |
| 4,137,665 | 2/1975 | Bierwiler | 446/83 |
| 4,293,127 | 10/1981 | Dudley | 272/900 X |

*Primary Examiner*—Joseph Falk

*Attorney, Agent, or Firm*—Harness, Dickey & Pierce

[57] ABSTRACT

A miniature theatre adapted for placement in a conventional doorway having a pair of support members held in place against opposite doorjambs by a pair of tension rods, one of which has a top curtain suspended therefrom, the other of which has a pair of curtains suspended therefrom, and a third tension rod compressibly extending between the doorjambs and supporting a bottom curtain. The support members extend rearwardly and support a fourth rod from which a backdrop is suspended.

9 Claims, 4 Drawing Figures

FIG. 2.
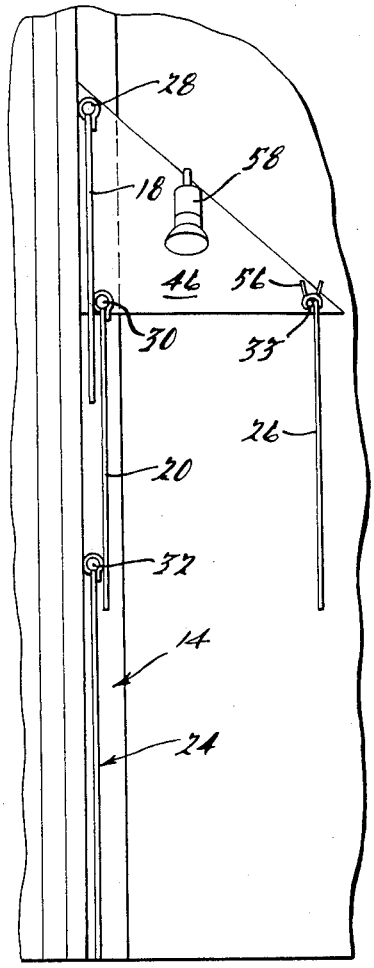
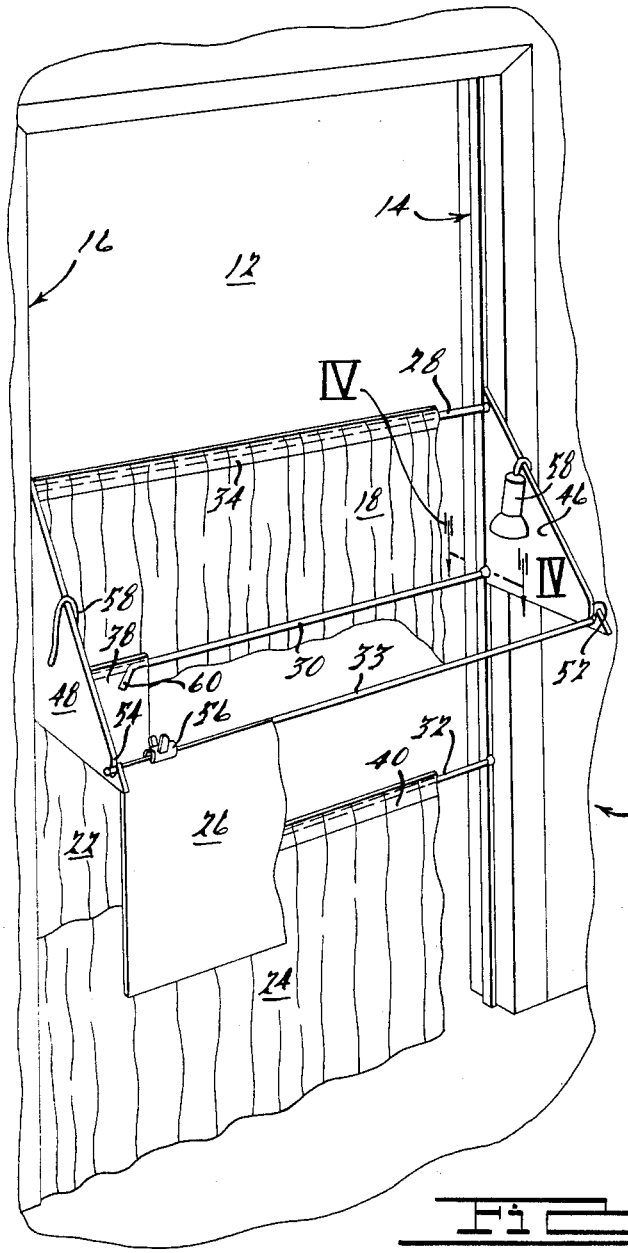
FIG. 3.

PLAY THEATRE

BACKGROUND AND SUMMARY OF THE INVENTION

The present invention relates to a miniature theatre. More particularly, the present invention relates to a theatre for hand actuated puppets or marionettes which is readily assembled within a door opening and is well suited for use by children.

Puppet theatres enhance the theatrical experience enjoyed by puppeteers and audience alike. This is particularly the case with puppet theatres primarily intended to be used by children. A stage or theatre can focus attention on the characters of the play and reduce distractions from the performance by, for example, concealing the puppeteer and providing a backdrop setting of suitable scenery. A good puppet theatre generally enhances the entertainment value of the performance.

Miniature theatres are known in the patent literature. For example, a doorway puppet stage is shown in U.S. Pat. No. 2,834,150 which issued May 13, 1958 to White. Other puppet or marionette theatres are shown in U.S. Pats. Nos. 2,705,386, Apr. 5, 1955 to Bertram; 2,837,863, June 10, 1958 to Duvall; 3,839,816, Oct. 8, 1974 to Fischereder; 3,899,168, Aug. 12, 1975 to Besherse and 4,137,665, Feb. 6, 1979 to Bierwiler. A toy theatre is shown in U.S. Pat. No. 2,368,188, Jan 30, 1984 to Wise.

Although miniature theatres are known, there remains a need for a truly portable miniature theatre which can be economically manufactured and yet which can be readily set up in a conventional doorway without damaging the doorway when used by children. It would also be advantageous if a miniature theatre could be provided which breaks down into a small package for shipping or storage and which is well suited for shipping without damage. It also would be desirable to provide a miniature theatre readily adapted for use by children of varying sizes.

Accordingly, the present invention provides such a miniature theatre which is well suited for use by children or even adults. The theatre of the present invention provides a stage for puppets or marionettes or other miniature figures. The present invention provides a theatre which can be economically manufactured and which can be used by puppeteers of small or large size. The theatre can be easily stored, shipped, or carried by a child to a playmate's home whereupon the theatre can be readily assembled for use and disassembled for storage or transport. Furthermore, the theatre has provision for backdrops which can be created by the puppeteer or premanufactured and for a lighting arrangement to more realistically simulate a real theatre. These and other advantages of the present invention will be understood from the following disclosure.

BRIEF DESCRIPTION OF THE DRAWINGS

FIG. 2 is a sectional view, broken away, taken along lines 2—2 in FIG. 1.

FIG. 3 is a rear perspective view of the preferred embodiment of the present invention, with one side curtain removed and portions broken away.

DESCRIPTION OF THE PREFERRED EMBODIMENT.

Generally speaking, a miniature theatre of the present invention comprises top, stage and bottom curtain tension rods respective with top, stage and bottom curtains suspended therefrom. The top and stage curtain tension rods hold a pair of support arms in place against a doorjamb. The support arms extend rearwardly and support a backdrop tension rod for suspension of a scenic or other desired backdrop. Optionally, the support arms can also support a stage lighting system.

Figure 1:
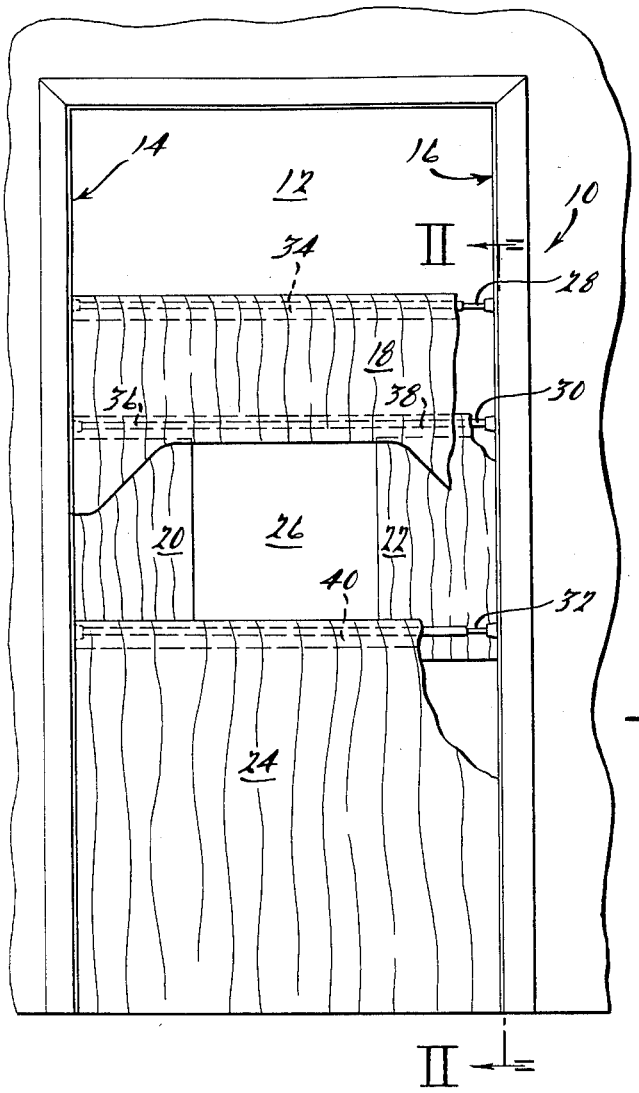
FIG. 1 is a front elevational view of a preferred embodiment of the present invention with portions broken away.

Now referring to the figures, a preferred embodiment of a theatre of the present invention is illustrated and indicated generally by the numeral 10. Theatre 10 is adapted to fit in a conventional doorway 12 between doorjambs 14 and 16. As best shown in FIG. 1, theatre 10 presents to the audience the appearance of a conventional stage with a top curtain 18, stage curtains 20 and 22, bottom curtain 24 and backdrop 26.

As best shown in FIG. 3 which shows theatre 10 from the puppeteer's point of view, each of top curtain 18, stage curtains 20 and 22 and bottom curtain 24 are suspended from associated top curtain tension rod 28, stage curtain tension rod 30 and bottom curtain tension rod 32, respectively. Curtains 18, 20, 22 and 24 are of suitable cloth such as a velour and are each folded over and sewn along a top edge to provide sleeves or rod pockets 34, 36 and 38 and 40, respectively, through which tension rods 28, 30 and 32 extend respectively.

Tension rods 28, 30 and 32 are conventional spring biased curtain rods such as are readily commercially available. thus, tension rod 30 has an end portion 42 which fits telescopically into the main body of rod 30 and is axially spring biased to the right as viewed in FIG. 3. Tension rod 30 also has a rubber foot 44 at each end. The length of tension rod 30 in a relaxed state or the axial tension of tension rod 30 in a compressed state can be adjusted by rotating end portion 42 with respect to the main body of rod 30. Tension rods 28 and 32 are of a construction analogous to tension rod 30.

Figure 4:
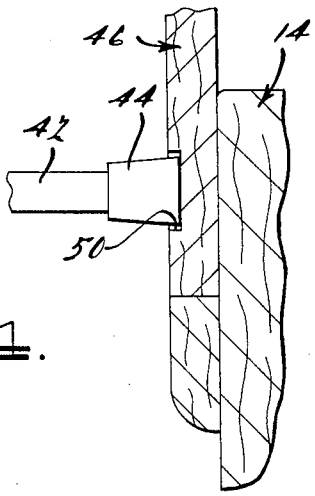
FIG. 4 is a sectional view, broken away, taken along lines 4—4 in FIG. 3.

Tension rods 28 and 30 extend between side support arms 46 and 48 and are compressed between doorjambs 14 and 16. Thus, tension rods 28 and 30 are axially spring biased to hold side support arms in place against doorjambs 14 and 16. As shown in FIG. 4, foot 44 of rod 30 locates in a recess 50 in support arm 48. Analogous recesses are provided in support arms 46 and 48 for the other feet of tension rods 28 and 30.

Side support arms 46 and 48 are shown as triangular in shape in side elevation although, of course, other shapes can be used so long as the shape extends rearwardly to provide support for backdrop rod 33. Thus, side support arms 46 and 48 have notches 52 and 54 for holding backdrop rod 33. Backdrop rod 33 is preferably adjustable in length and itself serves to support backdrop 26 which is suspended therefrom by conventional paper clamps 56. Backdrop 26 can be paper with the desired scene drawn or painted thereon. Numerous backdrops 26 can be provided and selectively used. It may be desired, for example, to provide backdrops onto which scenes have been drawn or printed but not colored. Coloring can then be done by a child in preparation for use.

Side support arms 46 and 48 also support stage lights 58 which can be any low wattage light such as are readily commercially available. Clamp on lights with low wattage, amber colored par bulbs are excellent and can produce dramatic results.

It will be appreciated that the construction of the present puppet theatre is very flexible in height adjustment and thus can be used by children of all heights. In addition, the structure is flexible in terms of width adjustment and can be easily adapted to doorways of various widths.

To assemble theatre 10 is simple and easy and takes but a few moments. First, a desired doorway is selected. A doorway entry into a living room or family room is usually ideal. The audience can then be comfortably seated around the puppet theatre while the puppeteers remain behind the curtains of the theatre.

Next tension rod 32 is inserted through rod pocket 40 of the bottom curtain 24. This can be facilitated by removal of one of the rubber feet of the rod, feeding the rod through the rod pocket and then replacing the rubber foot on the rod. The tension rod end portion of tension rod 32 is turned until there is enough tension to hold bottom curtain 24 level and approximately ½" above the floor. The rod is then positioned between doorjambs near the vertical center of the door frame.

Then tension rod 30 is inserted through the rod pockets 36 and 38 of the side or stage curtains 20 and 22. Preferably, stage curtains 20 and 22 have Velcro ® tabs 60 for holding the curtain to the side during the play. The Velcro ® tabs 60 are to the center. Next, support arms 46 and 48 are held against respective doorjambs 14 and 16 with the slotted, pointed end away from the contemplated audience and the ends of tension rod 30 are positioned in the appropriate recesses in support arms 46 and 48. The height of support arms 46 and 48 is adjusted so that the bottom of the stage curtains 20 and 22 are about ½" below the top of the bottom curtain 24. The end portion of tension rod 30 is turned until it holds support arms 46 and 48 and stage curtains 20 and 22 firmly in place.

Next, tension rod 28 is inserted through rod pocket 34 of top curtain 18, the rubber feet of tension rod 28 are inserted into the appropriate recesses of support arms 46 and 48 and the end portion of tension rod 28 is turned until rod 28 is compressed firmly in place. The curtains of the theatre 10 can now be adjusted as desired.

Finally, backdrop rod 33 is located into notches 52 and 54 of support arms 46 and 48 and a desired backdrop 26 is hung therefrom by using clamps 56. Lights 58 can be clamped onto support arms 46 and 48.

It will be appreciated by those skilled in the art that the present invention is subject to modification and variation. therefore, it should be understood that such modification and variations shall be within the spirit and scope of the present invention which is defined by the appended claims.

What is claimed is:

1. A kit for making a miniature theatre from disassembled components for use in a doorway having a pair of doorjambs, said kit comprising; a pair of generally planar support members, a top curtain having a first rod pocket, a first spring biased rod adapted to suspend said top curtain therefrom and to extend through said first rod pocket, a pair of side curtains having respective second and third rod pockets, a second spring biased rod adapted to suspend said side curtains therefrom and extend through said second and third rod pickets, a bottom curtain having a fourth rod pocket and a third spring biased rod adapted to extend through said fourth rod pocket to suspend said bottom curtain therefrom and to extend in compression between the doorjamb, said curtains defining an opening for a stage, said first and second rods also adapted to compressibly extend between each support member to hold said support members between the first and second rods and the doorjamb, said support members each having rod support means, and a fourth rod, so that when the support members are positioned between the first and second rods and the door jamb, the fourth rod is adapted to be supported, in a laterally spaced relation, from the doorway.

2. A kit as in claim 1 having, in addition, a light fixture adapted for attachment to one of said support members to illuminate said opening.

3. A kit as in claim 2 wherein said support members have recesses for receiving end portions of said first and second rod members.

4. A kit as in claim 3 wherein said support members each have a notch for receiving respective end portions of said fourth rod.

5. A miniature theatre in a doorway having a pair of doorjambs, said theatre having a pair of generally planar support members each held against one of said doorjambs by first and second tension rods extending in compression therebetween, a top curtain suspended from said first rod and a pair of side curtain suspended from said second rod, said second rod being positioned below said first rod, a third tension rod positioned between the doorjambs and extending in compression therebetween below said second rod, and a bottom curtain suspended from said third rod, said curtains defining an opening for a stage, said support members removably supporting a fourth rod laterally spaced from the doorway with a backdrop curtain suspended from the fourth rod.

6. A theatre as in claim 5 having, in addition, a light fixture adapted for attachment to one of said support members.

7. A theatre as in claim 6 wherein said support members have recesses for receiving end portions of said first and second rod members.

8. A theatre as in claim 7 wherein said support members each have a notch for receiving respective end portions of said fourth rod.

9. A miniature theatre in a doorway having a pair of doorjambs, said theatre having a pair of generally planar support members each held against one of said doorjambs by first and second tension rods extending in compression therebetween, a top curtain suspended from said first rod and a pair of side curtain suspended from said second rod, said second rod being positioned below said first rod, a third tension rod extending in compression between the doorjambs and below said second rod, a bottom curtain suspended from said third rod, said curtain defining an opening for a stage, and a fourth rod supported by said support members to suspend a backdrop behind said opening and including means for removably suspending the backdrop from said fourth rod and for sliding the backdrop along said fourth rod.

* * * * *

UNITED STATES PATENT AND TRADEMARK OFFICE

CERTIFICATE OF CORRECTION

PATENT NO. : 4,721,490

DATED : January 26, 1988

INVENTOR(S) : Edward F. Draugelis

It is certified that error appears in the above-identified patent and that said Letters Patent is hereby corrected as shown below:

Column 4, line 1 - "pickets" should be --pockets--.

Column 4, line 30 - "curtain" should be --curtains--.

Column 4, line 54 - "curtain" should be --curtains--.

Signed and Sealed this

Eighth Day of November, 1988

*Attest:*

DONALD J. QUIGG

*Attesting Officer*

*Commissioner of Patents and Trademarks*